US008517761B2

(12) United States Patent
Frenkil

(10) Patent No.: US 8,517,761 B2
(45) Date of Patent: Aug. 27, 2013

(54) POWER SUPPLY CORD STORAGE MECHANISM

(76) Inventor: Leonard Frenkil, Baltimore, MD (US)

( * ) Notice: Subject to any disclaimer, the term of this patent is extended or adjusted under 35 U.S.C. 154(b) by 0 days.

(21) Appl. No.: 13/327,258

(22) Filed: Dec. 15, 2011

(65) Prior Publication Data

US 2012/0322296 A1 Dec. 20, 2012

Related U.S. Application Data

(60) Provisional application No. 61/498,241, filed on Jun. 17, 2011.

(51) Int. Cl.
*H01R 13/72* (2006.01)

(52) U.S. Cl.
USPC ..... 439/501

(58) Field of Classification Search
USPC ..... 439/501, 502; 174/35; 242/405.2, 242/402, 406, 400.1; 191/24.2; 248/51
See application file for complete search history.

(56) References Cited

U.S. PATENT DOCUMENTS

| | | | | |
|---|---|---|---|---|
| D229,668 | S | 12/1973 | Boone | |
| 4,095,871 | A * | 6/1978 | Holte | 439/501 |
| 4,475,649 | A | 10/1984 | Haarbosch | |
| D294,487 | S | 3/1988 | Bannigan | |
| 4,778,125 | A | 10/1988 | Hu | |
| 5,507,667 | A | 4/1996 | Hahn et al. | |
| 5,782,649 | A | 7/1998 | Aiken | |
| D400,175 | S * | 10/1998 | Okamoto | D13/139.7 |
| 5,819,894 | A * | 10/1998 | Okamoto | 191/12.4 |
| 5,984,224 | A * | 11/1999 | Yang | 242/400.1 |
| 6,286,777 | B1 | 9/2001 | Black | |
| 6,331,936 | B1 | 12/2001 | Hom et al. | |
| 6,361,368 | B1 * | 3/2002 | Tseng | 439/619 |
| 6,428,348 | B1 | 8/2002 | Bean | |
| 6,450,436 | B1 * | 9/2002 | Tsuji et al. | 242/400.1 |
| 6,567,277 | B1 * | 5/2003 | Doherty et al. | 361/826 |
| 6,636,432 | B2 | 10/2003 | Chao | |
| 6,698,560 | B2 * | 3/2004 | Reardon et al. | 191/12 R |
| 6,740,817 | B1 | 5/2004 | Anderson | |
| 6,746,272 | B2 | 6/2004 | Bean | |
| 6,861,822 | B2 * | 3/2005 | Wei | 320/111 |
| 6,962,306 | B2 | 11/2005 | West | |
| 7,044,775 | B2 * | 5/2006 | Yang | 439/502 |

(Continued)

FOREIGN PATENT DOCUMENTS

| | | | |
|---|---|---|---|
| DE | 197930003 | U1 | 8/1981 |
| EP | 421906 | A1 | 4/1991 |
| EP | 2086082 | A1 | 8/2009 |

OTHER PUBLICATIONS

U.S. Non-Final Office Action for U.S. Appl. No. 13/416,955 dated Jan. 8, 2013, 18 pages.

(Continued)

*Primary Examiner* — Alexander Gilman
(74) *Attorney, Agent, or Firm* — Fish & Richardson P.C.

(57) ABSTRACT

An apparatus including a power supply unit, and a plurality of extensions extending outwardly from opposing side surfaces of the power supply unit, the extensions cooperating with the power supply unit to form a channel between the extensions, wherein at least one end of each of the plurality of extensions defines a recess in the at least one end that is configured to receive and retain a part of a flexible portion of an electrical power cord.

18 Claims, 11 Drawing Sheets

(56) References Cited

U.S. PATENT DOCUMENTS

| | | | | |
|---|---|---|---|---|
| 7,077,693 | B1 * | 7/2006 | Symons | 439/501 |
| 7,121,877 | B2 | 10/2006 | Lin | |
| 7,563,130 | B2 | 7/2009 | Farrar et al. | |
| 7,803,012 | B2 * | 9/2010 | Shen et al. | 439/501 |
| 7,815,025 | B2 * | 10/2010 | Chen et al. | 191/12 R |
| 7,871,291 | B2 | 1/2011 | Tracy et al. | |
| D649,017 | S | 11/2011 | Stieler | |
| D667,390 | S | 9/2012 | Matera | |
| 2003/0137810 | A1 | 7/2003 | Chen | |
| 2004/0097126 | A1 | 5/2004 | Chen | |
| 2004/0203277 | A1 * | 10/2004 | Chien | 439/501 |
| 2010/0139950 | A1 | 6/2010 | Chen | |

OTHER PUBLICATIONS

PCT Notification of Transmittal of the International Search Report and the Written Opinion for International Application No. PCT/US2012/041590 dated Jan. 30, 2013, 12 pages.

* cited by examiner

POWER SUPPLY CORD STORAGE MECHANISM

CROSS-REFERENCE TO RELATED APPLICATIONS

This application claims priority to and the full benefit of U.S. Provisional Application Ser. No. 61/498,241, filed Jun. 17, 2011, and titled "Power Supply Cord Storage," the entire content of which is incorporated herein by reference.

TECHNICAL FIELD

This disclosure relates to management and storage of power supply cords for electric and electronic devices.

BACKGROUND

Electric and electronic devices, such as computers, printers, displays, or other devices derive power from a domestic source, such as a 120 or 240 volt outlet or line. The power supply for providing power to these devices usually includes a power supply unit that transforms or modifies electrical energy and one or two associated power cords. The power cords usually include a high voltage line cord that couples to and derives power (typically AC) from a wall outlet and connects to the power supply unit, and an output line (typically lower voltage DC) that couples to the power supply unit and the electric or electronic devices to be driven by the converted electricity. When not in use, or when a user, for example, is traveling, a user will often wrap the power cords, around the power supply unit, for storage or management of the cords and power supply unit. However, these and other wrapping methods fail to facilitate the orderly wrapping or maintenance of the associated power cords, nor do they provide for the securing of the power cord ends. Invariably, the unsecured ends and the cords become loose and tangled or for lack of a readily usable storage solution, the power cords are simply left in a jumble to be untangled later. Typically, laptops and other power supply units are delivered with a "Velcro®-like" tape intended to secure the cords to the body of the power supply unit. This turns out to be an inefficient and mediocre solution to the problem at best and users then tend to ignore the tape or find it annoying and remove it.

SUMMARY

The disclosed implementations provide a simple, quick, and convenient means of managing the orderly use and storage of power cords of portable electric and electronic power supply units. It may be implemented in the initial manufacture and made a part of the power supply unit or it may be implemented retrospectively by being attached either releasably or permanently to the power supply unit body. The design assists in the maintenance of orderly control of the power cord(s) whether being extended partially or fully. For example, the recesses formed in the ends of the extensions or guides discussed herein allow capture of various sized power cords at any location along the flexible portion of the cord, so that if a user wants to shorten or lengthen the cord during use, the present implementations provide a quick, unique, and easy means of doing so.

In one general aspect, an apparatus includes a power supply unit, and a plurality of extensions extending outwardly from opposing side surfaces of the power supply unit, the extensions cooperating with the power supply unit to form a channel between the extensions, wherein at least one end of each of the plurality of extensions defines a recess in the at least one end that is configured to receive and retain a part of a flexible portion of an electrical power cord.

Implementations can optionally include one or more of the following features. For example, each end of each of the plurality of extensions defines a recess configured to receive and retain a part of the flexible portion of the electrical power cord. The recess includes a wedge-shaped notch configured to receive and retain a part of the flexible portion of the electrical power cord. The recess includes a substantially circular notch and wherein the at least one end of each of the plurality of extensions further defines a retention mechanism for retaining the part of the flexible portion of the electrical power cord within the recess. The recess includes a wedge-shaped notch configured to receive and retain a part of the flexible portion of the electrical power cord. The recess includes a substantially circular notch and wherein the at least one end of each of the plurality of extensions further defines a retention mechanism for retaining the part of the flexible portion of the electrical power cord within the substantially circular notch. The plurality of extensions are integral with the power supply unit or are releasably attachable to the power supply unit. The apparatus further includes an adhesive material disposed along a length of a side of each of the plurality of extensions, the adhesive material configured to interact with the power supply unit to releasably attach the plurality of extensions to the power supply unit. The adhesive material includes one of glue, adhesive strips, or a hook and loop fastener material. The recess is defined within a clip disposed on at least one end of each of the plurality of extensions. When not in use, the plurality of extensions are disposed within the power supply unit, and when in use, extend from the power supply unit.

In another general aspect, an apparatus includes at least two longitudinally extending guides configured to be coupled to opposite side surfaces of a power supply unit such that, when coupled to the power supply unit, the guides cooperate with the power supply unit to form a channel between the guides, at least one end of each of the guides defining a recess in the at least one end that is configured to receive and retain a part of a flexible portion of an electrical power cord and to cooperate with the power supply unit to retain the power cord in a wrapped arrangement substantially within the channel.

Implementations can optionally include one or more of the following features. For example, the at least two longitudinally extending guides include a substantially rectangular or oval cross-sectional body. The at least two longitudinally extending guides are shaped to match the contours of the side surfaces of the power supply unit or comprise materials that permit the guides to substantially conform to the contours of the side surfaces of the power supply unit. Each end of each of the guides defines a recess configured to receive and retain a part of the flexible portion of the electrical power cord, the recess comprising a wedge-shaped notch. Each end of each of the guides defines a recess configured to receive and retain a part of the flexible portion of the electrical power cord, the recess comprising a substantially circular notch, and wherein each end of each of the guides further defines a retention mechanism for retaining the part of the flexible portion of the electrical power cord within the substantially circular notch. Each of the guides further includes an adhesive material disposed along a length of a side of each of the guides, the adhesive material configured to interact with the power supply unit to couple the plurality of guides to the power supply unit. The adhesive material includes one of glue, adhesive strips, or a hook and loop fastener material. The recess is defined within a clip disposed on at least one end of each of the plurality of guides.

DETAILED DESCRIPTION

Figure 1:
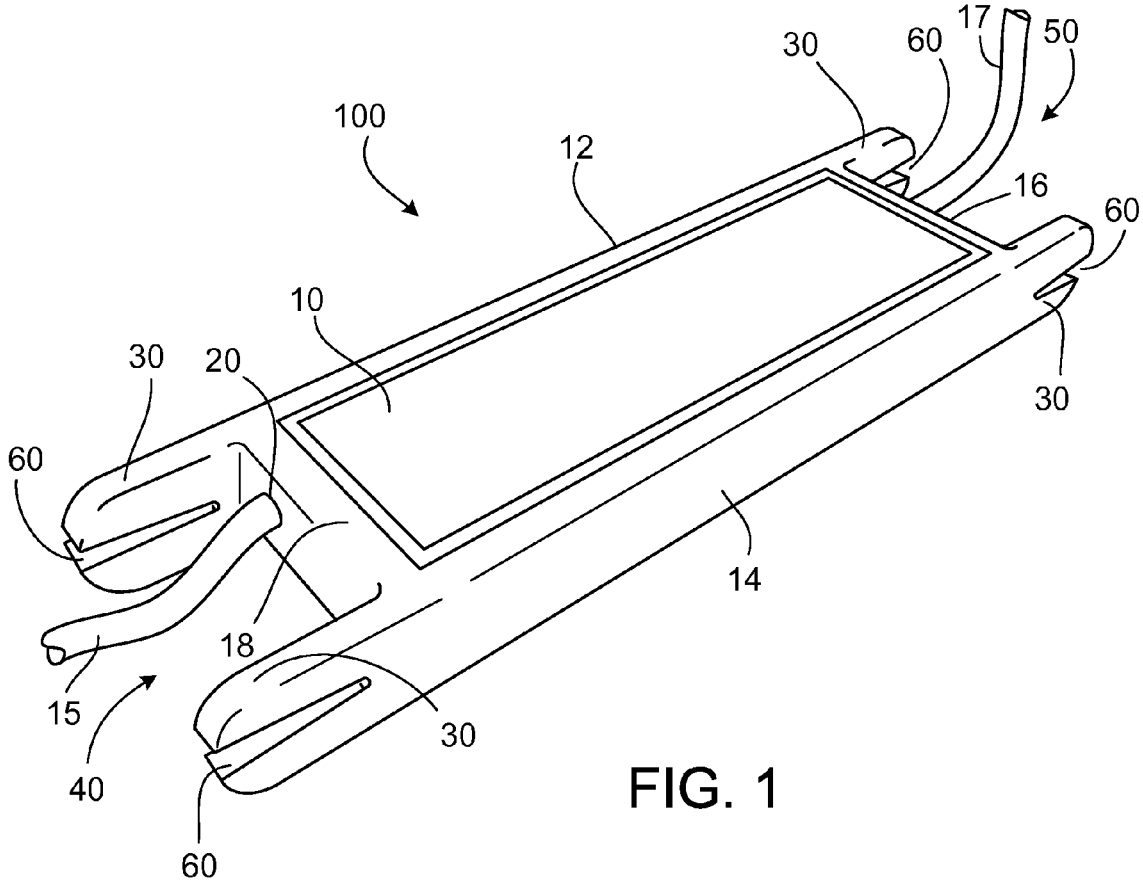
FIG. 1 illustrates an implementation of a cord wrap for a power supply unit.

Referring to the accompanying drawings in which like reference numbers indicate like elements, FIG. 1 illustrates an implementation of a cord wrap or cord caddy 100 for a power supply unit 10. Power supply unit 10 is used to provide electric power to any number of consumer electronic devices, such as computers, laptop computers, printers, displays, and other electric and electronic devices. A high voltage power cord 17 may be releasably connected at one of its ends to the power supply unit 10 at a port (not shown) formed in the power supply unit 10, and at an opposite of its ends to, for example, a wall outlet via common electrical prongs (not shown) formed at the end of the power cord 17. The high voltage power cord 17 delivers power from a domestic source, such as a 120 or 240 volt wall outlet to the power supply unit 10. A second low voltage power cord 15 may also be connected, or releasably connected, at one end to the power supply unit 10, such as for example to port 20 formed in the power supply unit 10, and at an opposite end of the cord 15 to a receiving port formed in the electronic device.

As shown in FIG. 1, the power supply unit 10 may include one or more extensions or guides 30. The extensions or guides 30 may be formed during, for example, the manufacture of the power supply unit 10 by extending opposite side surfaces 12, 14 in a longitudinal or transverse direction thereby forming guides 30 opposite one another at opposite ends 16, 18 of the power supply unit 10. Alternatively, the extensions or guides 30 may be permanently or releasably coupled to the power supply unit 10 after the unit 10 has been manufactured or during manufacture of the unit 10, as will be discussed in more detail below. The extensions or guides 30 may extend beyond the outer periphery of the power supply unit 10 for a desired length, for example, 25.4 mm to 50.8 mm (1 to 2 inches), depending upon the length of the high and low voltage power cords used. The extensions or guides 30 form channels or trough areas 40, 50 between them, respectively. The channel or trough areas 40, 50 generally conform to the width of the power supply unit 10.

Figure 2:
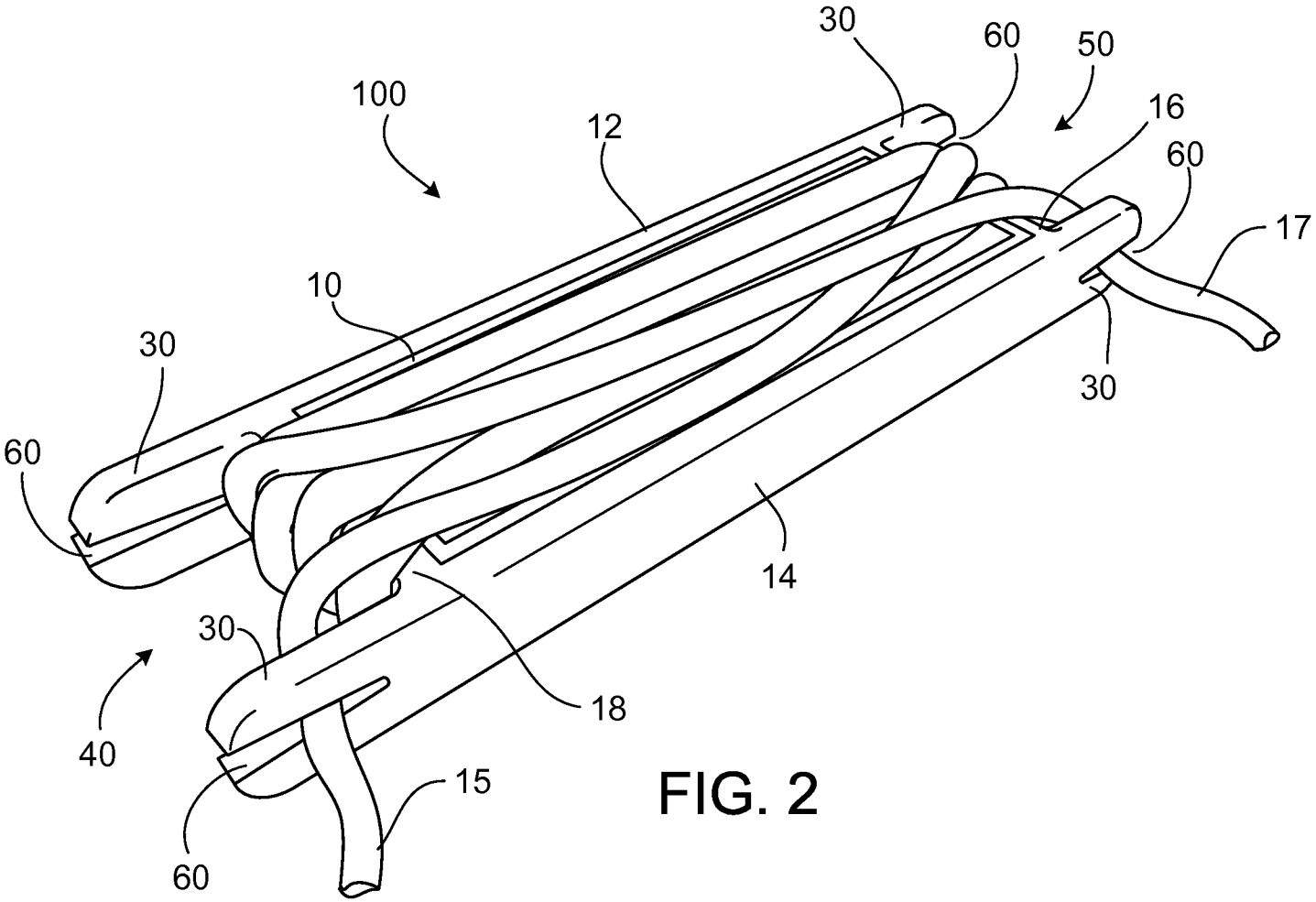
FIG. 2 illustrates the cord wrap of FIG. 1 with portions of the cords wrapped about the power supply unit.

Referring to FIG. 2, using the power supply unit 10 as a core or base, the high and low voltage cords 17, 15 connected to the power supply unit 10 may be wound around the power supply unit 10, for example, in a longitudinal or transverse direction around the power supply unit 10, such that the cords are held in place between the guides 30 at opposite ends of the power supply unit 10. In order to prevent the cords from unwinding, one or more of the extensions or guides 30 may include a recess, notch or other opening, such as wedge-shaped notches 60 formed in the extensions or guides 30. Once the power cords are wound around the power supply unit 10, end portions of the power cords may be inserted and wedged into the notches 60 to retain a portion of the cords in position. In order to remove the cords from the respective notches 60, a user simply has to pull the end portions of the power cords from the notches 60 at which point the user may unwind the cords from around the power supply unit 10 to the extent needed or desired.

Figure 3A:
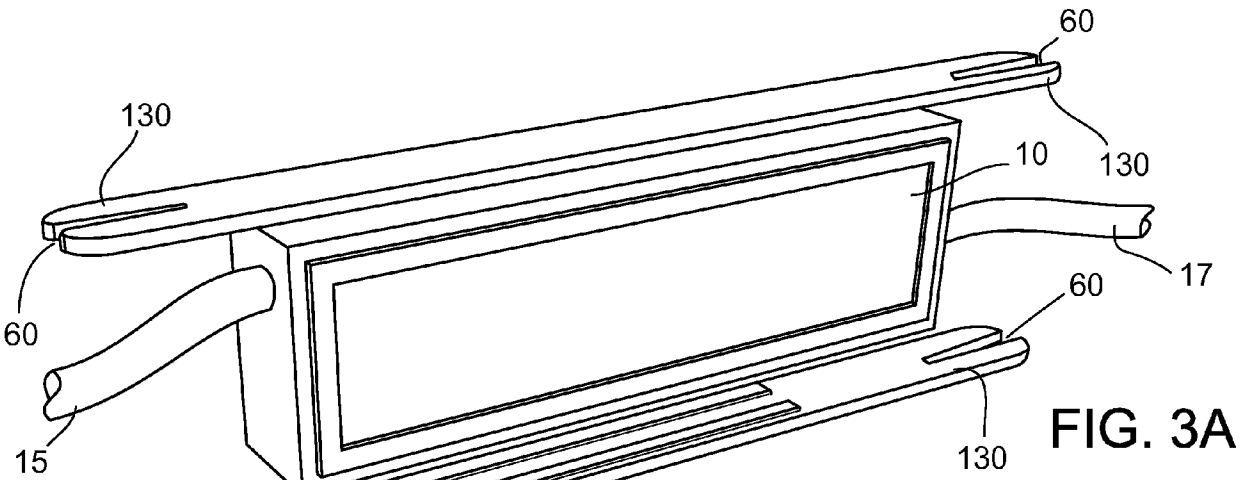
FIGS. 3A and 3B illustrate another implementation of a cord wrap for a power supply unit.
Figure 3B:
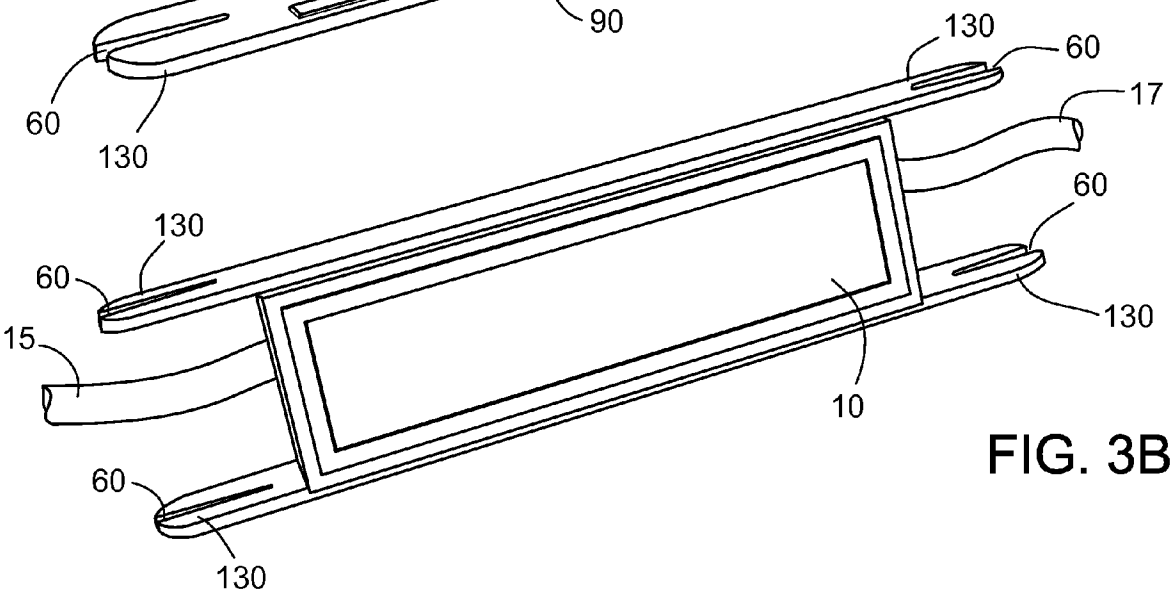

Referring to FIGS. 3A and 3B, in addition to forming the extensions or guides 30 during manufacture of the power supply unit 10, the extensions or guides may be retrofit onto an existing power supply unit 10. For example, as shown in FIGS. 3A, B, the extensions or guides 130 may be formed separate from the power supply unit 10 in the form of strips having a length such that they extend beyond the ends of the power supply unit 10 by a desired amount (e.g., 25.4 mm to 50.8 mm (1 to 2 inches)). An adhesive material 90 such as glue, adhesive strips, hook and loop fasteners, such as Velcro®, or other suitable material may be provided along a length of the extensions or guides 130 as shown in FIG. 3A. Alternatively, the adhesive material 90 may be provided along a length of the side of the power supply unit 10. The guides 130 may be brought into contact with the respective sides of the power supply unit 10 in order to form the power cord wrap assembly as shown in FIG. 3B. The guides 130 may be shaped or configured to match or generally conform to the shape of the power supply unit 10. For example, a number of power supply units 10 have slightly-angled side surfaces due to the design of the casing of the power supply unit 10. In those instances, the guides 130 may be shaped, for example, with an angle that closely or substantially matches the angle of the side surface of the power supply unit 10 to assist in adhering the guides 130 to the power supply unit 10. In addition, the adhesive material 90 may be formed such that any space between the guides 130 and the side of the power supply unit 10 are taken up or absorbed by the adhesive material 90 when the guides 130 are brought into contact with the sides of the power supply unit 10. It should be understood that the guides 130 may have any suitable shape in order to conform to the shape of the power supply unit 10.

Figure 4A:
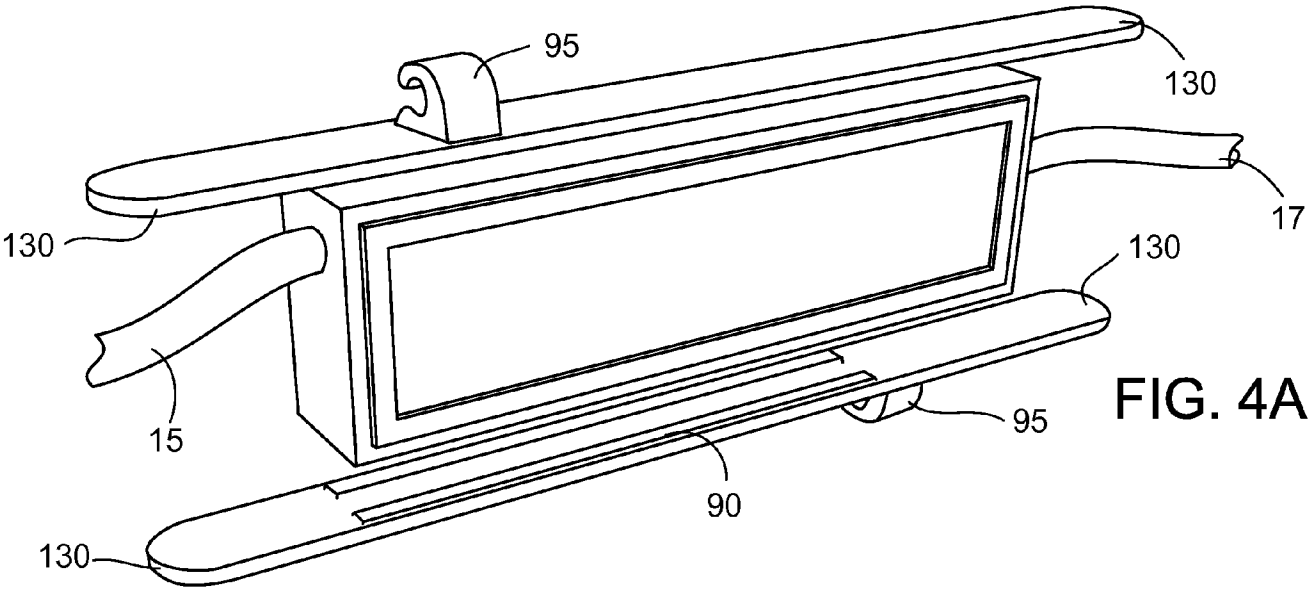
FIGS. 4A and 4B illustrate another implementation of a cord wrap for a power supply unit.
Figure 4B:
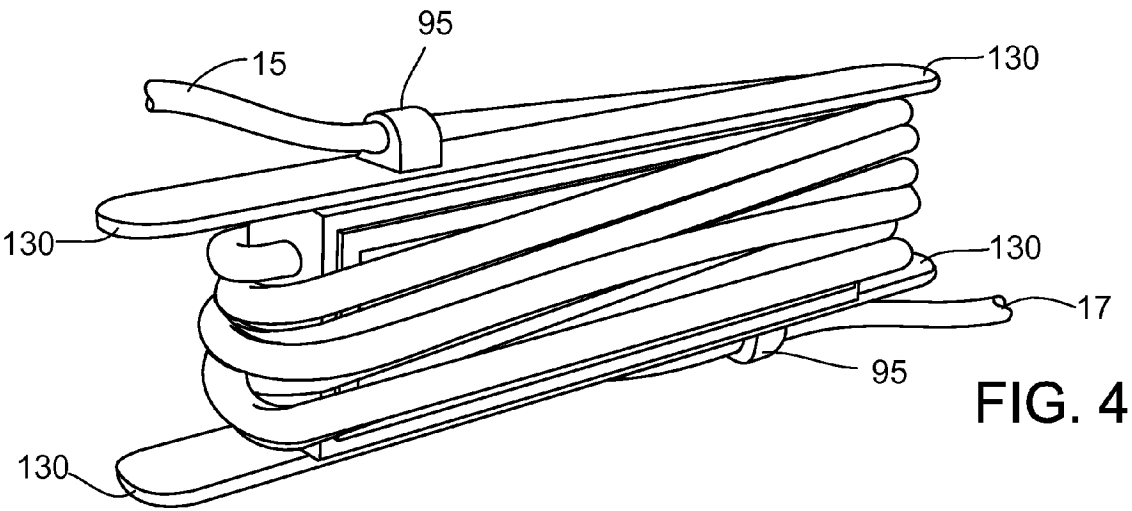

As also shown in FIGS. 3A, B, the guides 130 may also include notches or openings 60 as discussed above, or any of other suitable retention mechanisms for retaining a portion of the cords once the cords are wrapped about the power supply unit 10 for storage. Alternatively, the extensions or guides 130 may also include clips 95 (FIGS. 4A, B) made from a metal, plastic or other suitable material for securing a portion of the cords once the cords are wrapped around the power supply unit 10 to help prevent the cord from unwrapping. For example, once the cords are wrapped around the power supply unit 10, a portion of the cords may be snapped into place and received by the clips 95 (as shown in FIG. 4B).

Figure 5:
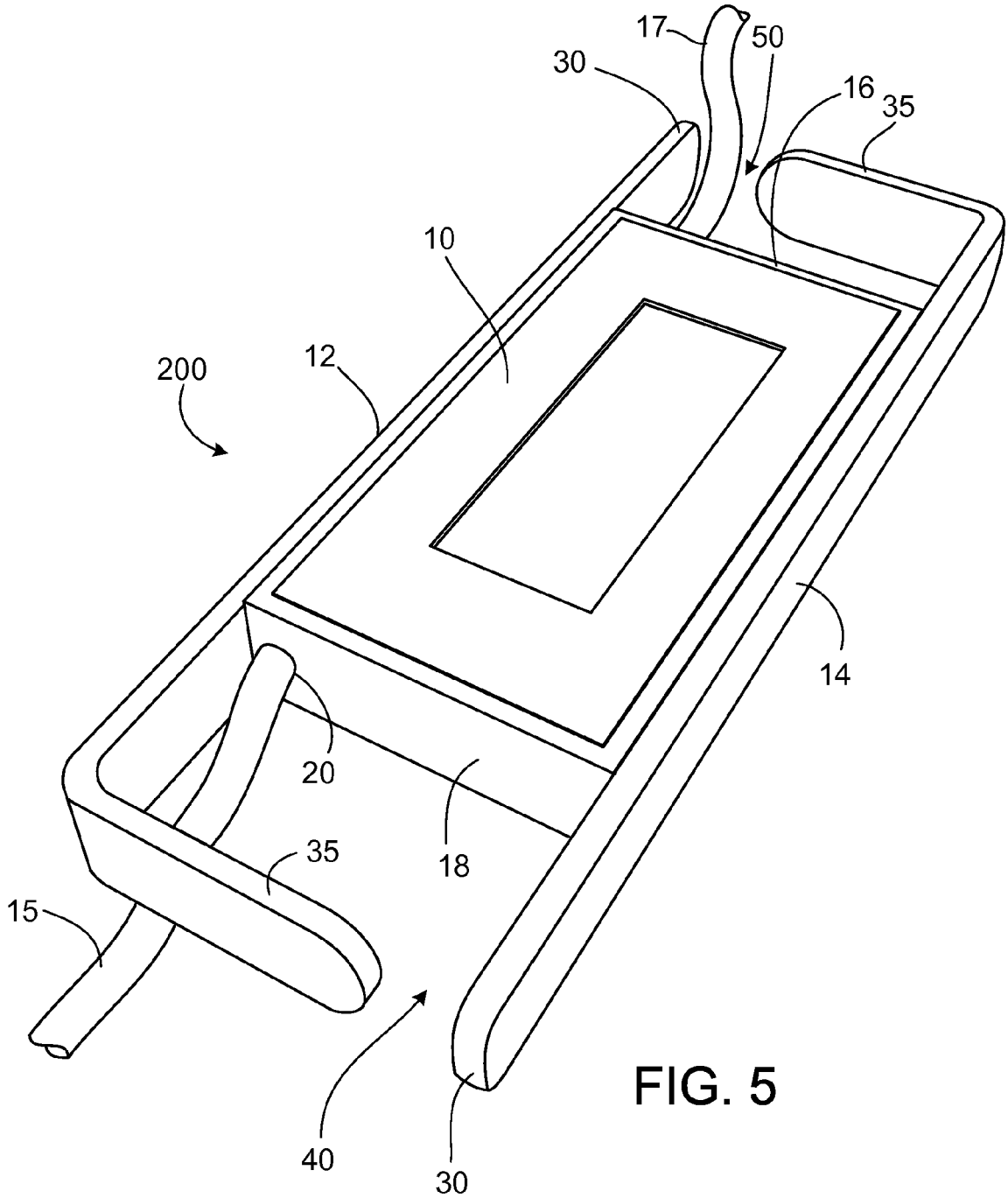
FIG. 5 illustrates another implementation of a cord wrap for a power supply unit.

Referring to FIG. 5, an alternative cord wrap 200 is shown. The power supply unit 10 may include one or more extensions or guides 30. The extensions or guides 30 may be formed during, for example, the manufacture of the power supply unit 10 by extending opposite side surfaces 12, 14 in a longitudinal or transverse direction thereby forming guides 30 opposite one another at opposite ends 16, 18 of the power supply unit 10. Alternatively, the extensions or guides 30 may be releasably coupled to the power supply unit 10 after the unit 10 has been manufactured or during manufacture of the unit 10. The extensions or guides 30 may extend beyond the outer periphery of the power supply unit 10 for a desired length, for example, 25.4 mm to 50.8 mm (1 to 2 inches), depending upon the length of the high and low voltage power cords 15, 17 used. The extensions or guides 30 form channels or trough areas 40, 50 between them, respectively. The channel or trough areas 40, 50 generally conform to the width of the power supply unit 10. In the implementation shown in FIG. 5, at least one end portion 35 of the extensions or guides 30 is formed in a substantially L-shaped configuration. The end portions 35 serve to further aid in retaining the wrapped cords 15, 17 in position around the periphery of the power supply unit 10. For example, as the cords 15, 17 are wrapped around the power supply unit 10, they tend to fill up the space formed by the channels or trough areas 40, 50. As the cords 15, 17 fill up the space, the outer portion of the wrapped cords 15, 17 may contact the end portions 35 such that the end portions 35 exert a force on the wrapped section of cords to help limit or prevent movement of the cords once the wrap is complete.

Figure 6:
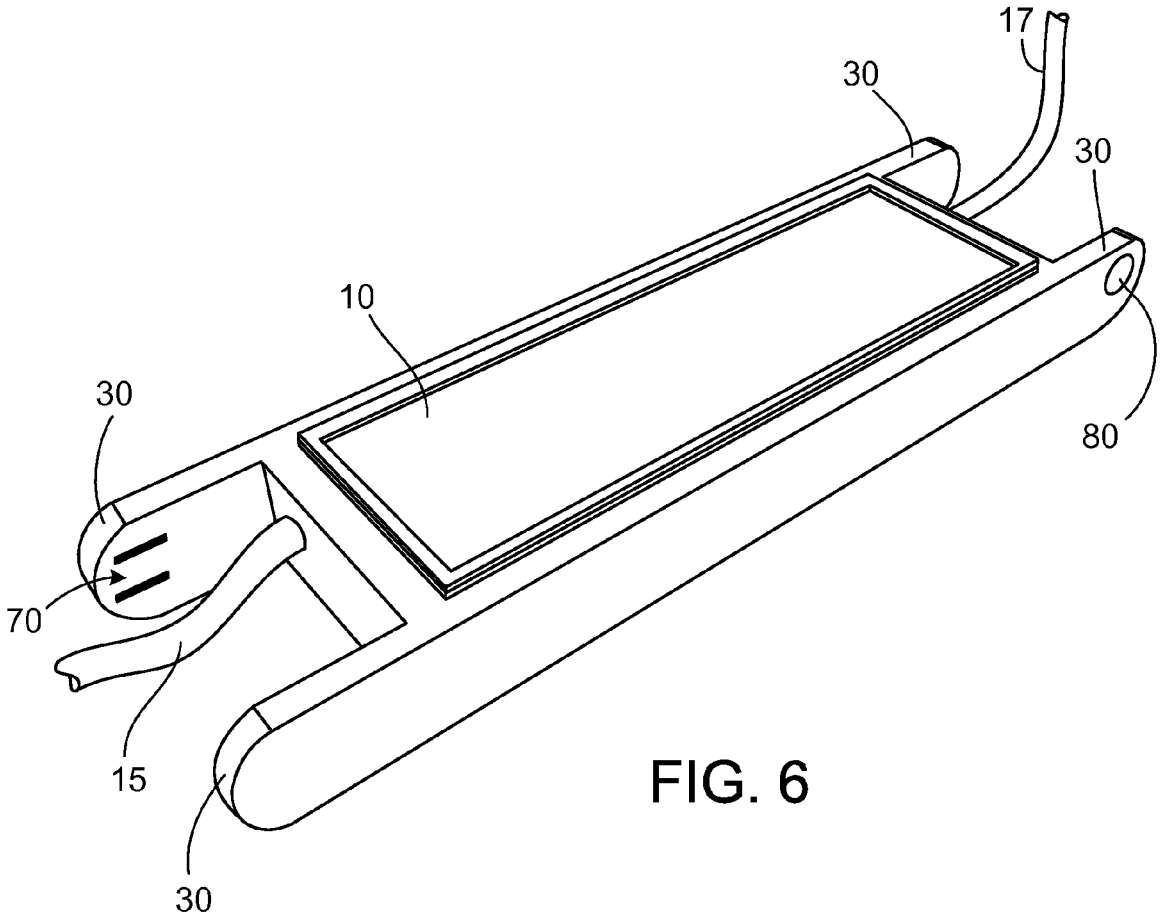
FIG. 6 illustrates another implementation of a cord wrap for a power supply unit.

FIG. 6 illustrates an alternative implementation for preventing the cords from unwinding once the cords 15, 17 are wrapped around the power supply unit 10. As illustrated in FIG. 6, one of the ends of the extensions or guides 30 may include one or more receptacles 70 formed in the shape and configuration of electrical prongs or plugs so that once the high voltage power cord 17 is wrapped around the power supply unit 10, the pronged or plugged end (not shown) of the power cord 17 may be plugged into the receptacles 70. Likewise, one of the ends of the extensions or guides 30 may include a hole or opening 80 formed to receive or mate with the connector end (not shown) of the low voltage power cord 15 once it is wrapped around the power supply unit 10. By receiving the respective ends of the power cords 15, 17, receptacles 70 and opening or hole 80 provide a convenient way of retaining the cords 15, 17 in a wrapped configuration around the power supply unit 10.

Figure 7:
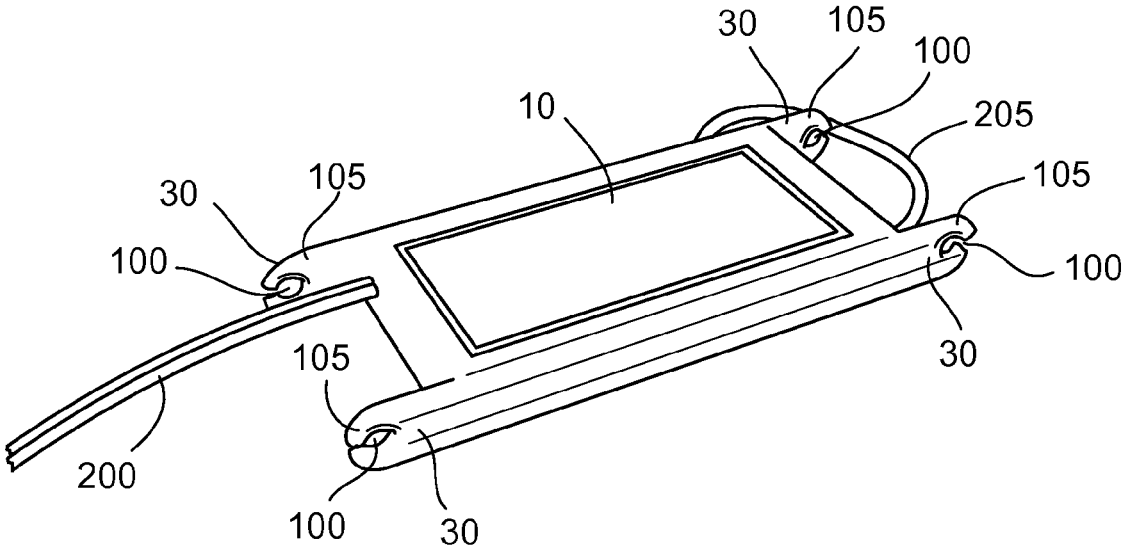
FIG. 7 illustrates another implementation of a cord wrap for a power supply unit.

FIG. 7 shows an implementation of the cord wrap with recesses formed in the ends of the extensions or guides 30 having substantially oval cross-sectional shaped body portions, in the shape of a circular notch or groove 100 for receiving a portion of the flexible part of an electrical power cord, such as the flexible portions 200, 205 of the power cords illustrated in FIG. 7. In order to further restrict movement and retain the flexible portions 200, 205 within the notch or grooves 100, the ends of the extensions or guides 30 are formed with retention fingers, clasps or other mechanisms 105 through which the flexible portions 200, 205 may pass and remain entrapped in the notch or grooves 100 until a user pulls the flexible portions 200, 205 through the mechanisms 105 to free the flexible portions 200, 205 from the recesses 100.

Figure 8:
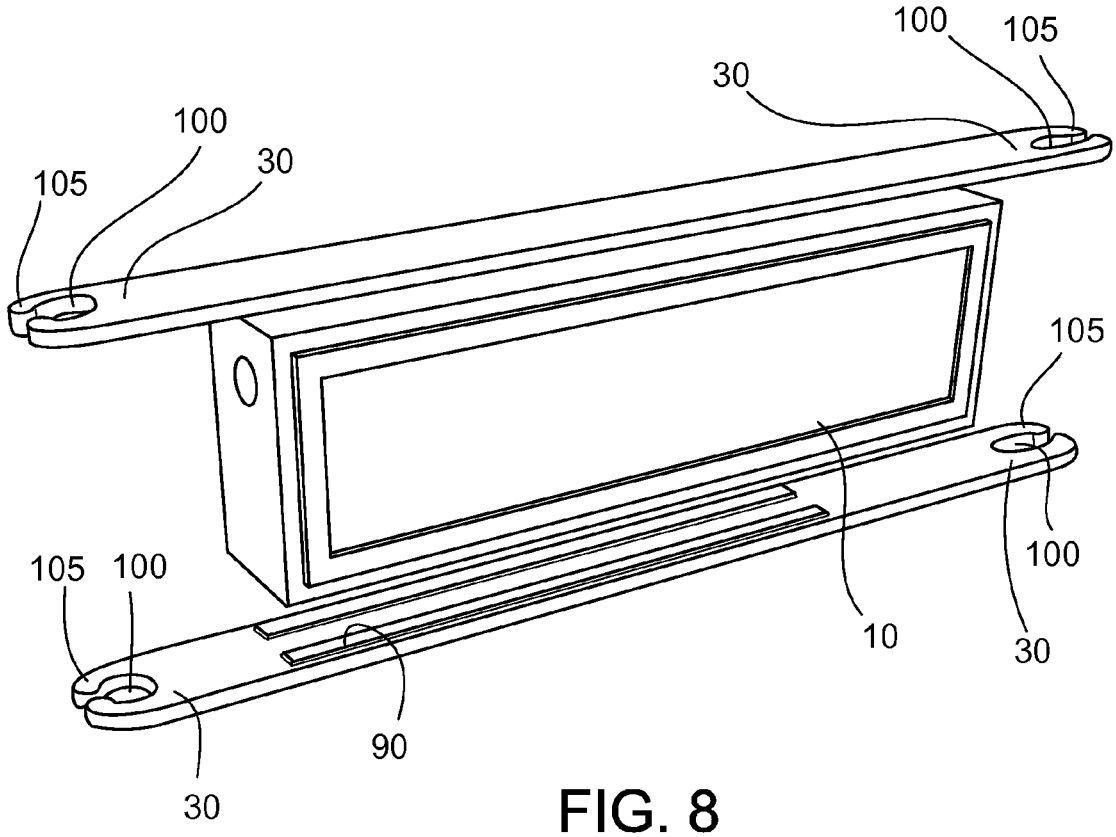
FIG. 8 illustrates another implementation of a cord wrap for a power supply unit.

FIG. 8 shows an alternative implementation of the extensions or guides 30 of FIGS. 3A and 3B. As illustrated in FIG. 8, instead of the extensions or guides 30 including notches or openings 60 as discussed above with respect to FIGS. 3A and 3B, the guides 30 may include recesses formed in the shape of a circular notch or groove 100 for receiving a portion of the flexible part of an electrical cord (not shown). Like the implementation shown in FIG. 7, in order to further restrict movement and retain the flexible portions 200, 205 within the notch or grooves 100, the ends of the extensions or guides 30 are formed with retention mechanisms 105 in a similar manner as described above with respect to the implementation of FIG. 7.

Figure 9A:
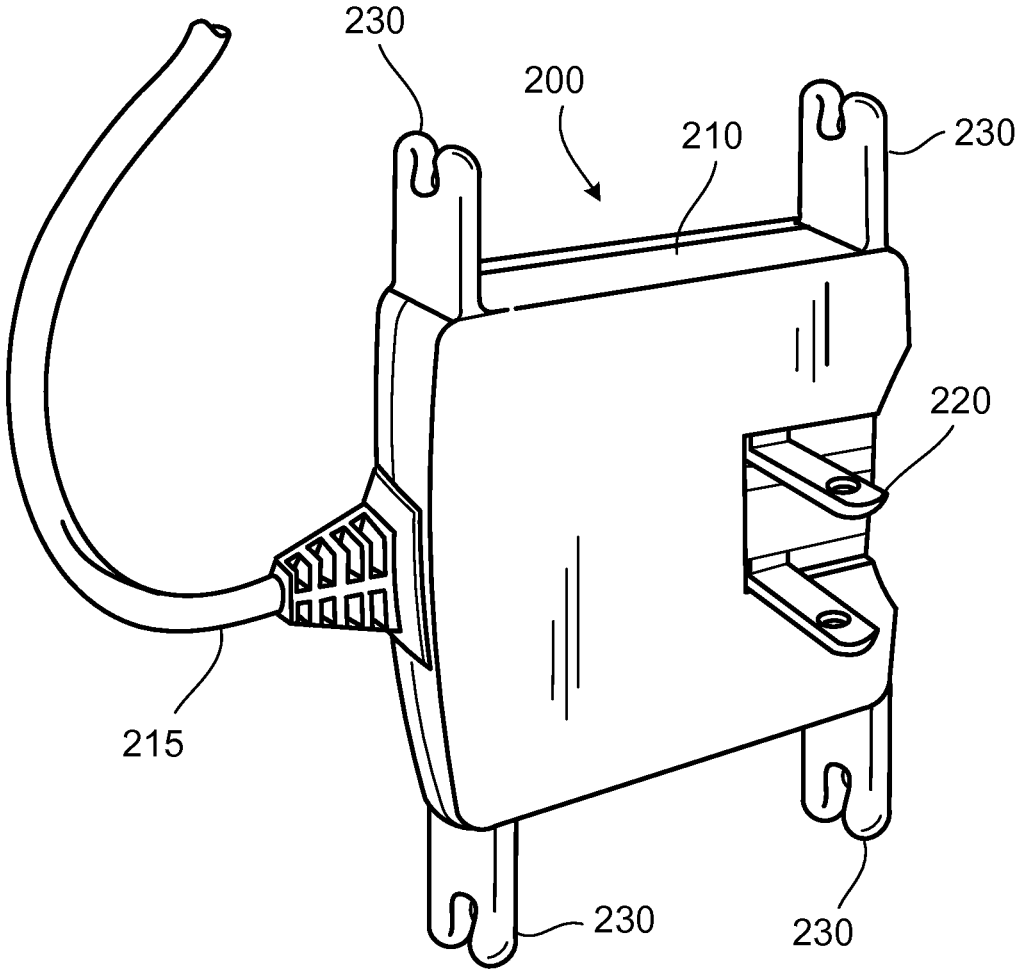
FIGS. 9A-9C illustrate other implementations of a cord for a power supply unit.
Figure 9B:
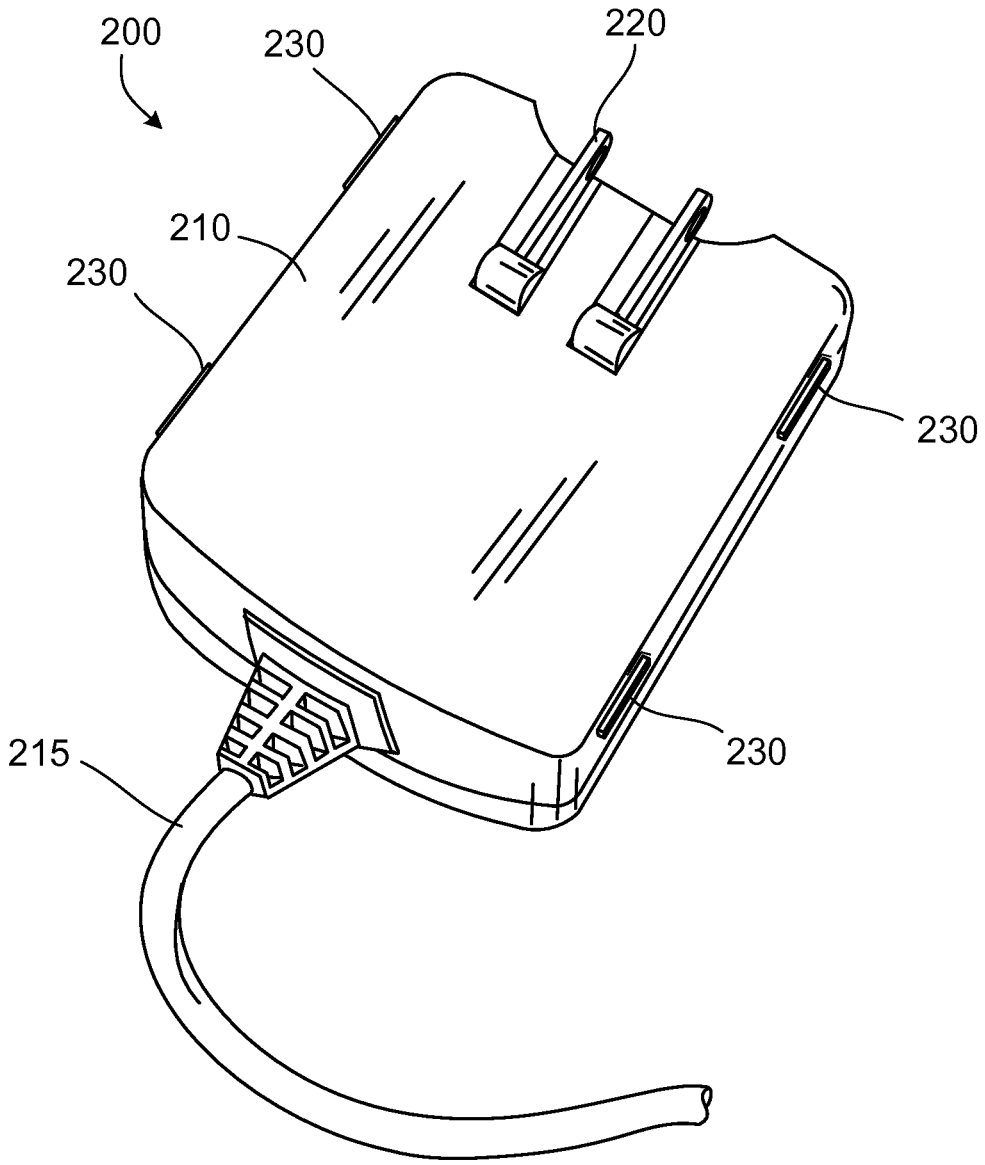
Figure 9C:
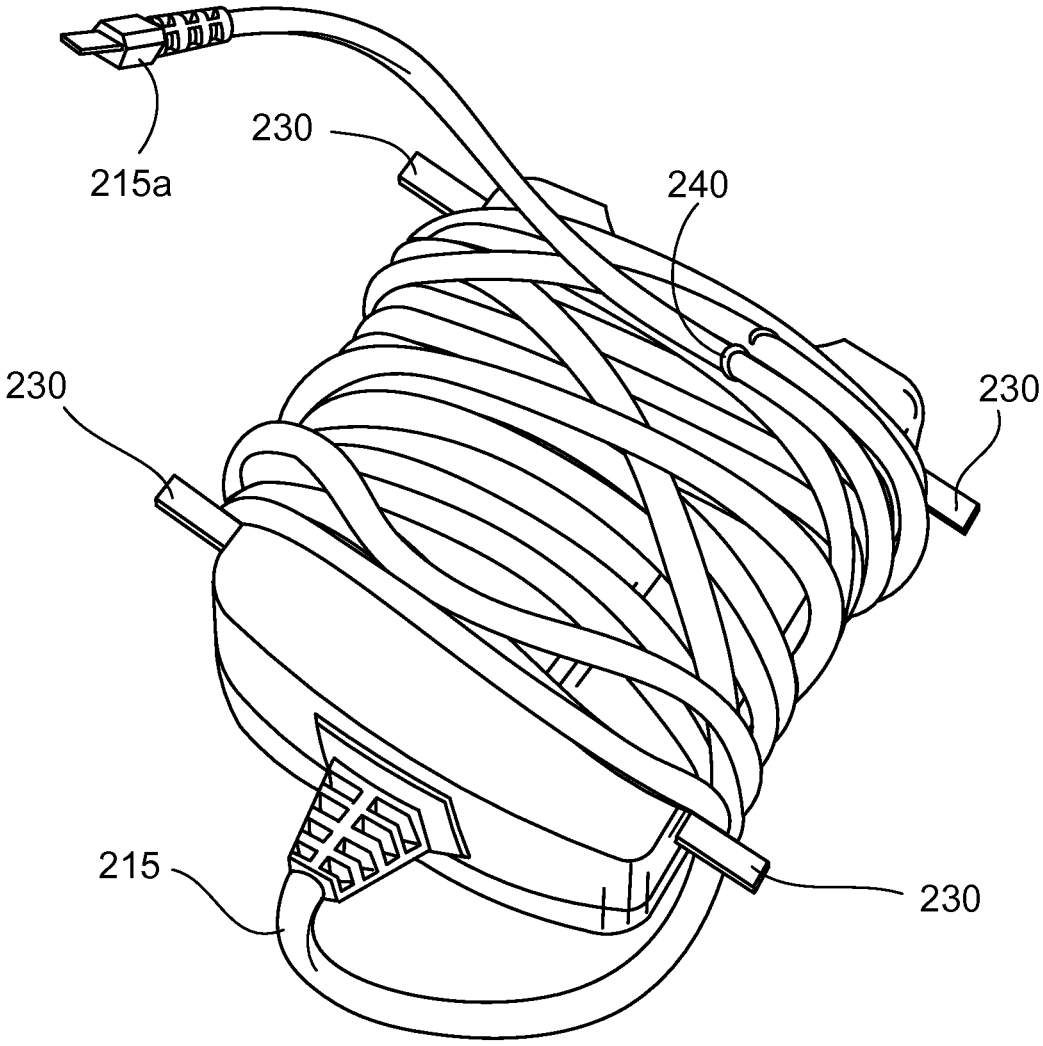

FIGS. 9A-9C illustrate alternative implementations of a cord wrap assembly 200 for use with a power supply unit 210. As illustrated in FIGS. 9A-9C, the power supply unit 210 includes electrical prongs 220, which may be plugged into, for example, a wall outlet. The prongs 220 are movable between an open or extended position (FIG. 9A) and a closed position (FIGS. 9B, 9C). Including the prongs 220 as part of the power supply unit 210 eliminates the need for an additional high voltage power cord as discussed above. A low voltage power cord 215 may also be connected, or releasably connected, at one end to the power supply unit 210 and at an opposite end of the cord 215 to a receiving port formed in an electronic device, such as, for example, a laptop computer, phone, or wireless router device. As shown in FIG. 9C, the cord 215 may include a connecter 215*a*, such as a Universal Serial Bus (USB) connector, formed at one of its ends for connecting to a mating USB receiving port (not shown) in the electronic device.

As shown in FIG. 9A, the power supply unit 210 may include one or more extensions or guides 230 formed integral with the body of the power supply unit 210 and formed with openings for receiving a portion of the power cord 215 as discussed above. Alternatively, the guides 230 may be removably attached to the power supply unit 210 as described above. Referring to FIGS. 9B and 9C, the extensions or guides 230 may be attached or disposed on the power supply unit 210 such that they are movable between a closed position when not in use (FIG. 9B) and an open or extended position (FIG. 9C). The extensions or guides 230 may extend beyond the outer periphery of the power supply unit 210 for a desired length, for example, 25.4 mm to 50.8 mm (1 to 2 inches) or less, depending upon the length of the power cord used and the dimensions of the particular power supply unit 210. Referring to FIG. 9C, using the power supply unit 210 as a core or base, the power cord 215 may be wound around the power supply unit 210, for example, in a longitudinal or transverse direction around the power supply unit 210, such that the cord 215 is held in place between the guides 230 at opposite ends of the power supply unit 210. Once the cord 215 is wound around the power supply unit 210, a clip 240, which is slidably or permanent attached to a portion of the power cord 215 may be used to retain another portion of the cord 215 as shown in FIG. 9C. Alternatively, one or more of the extensions or guides 230 may include a recess, such as a notch or other opening as discussed above to assist in retention of the cord 215 in a wrapped configuration about the power supply unit 210. Alternatively, a clip, such as clip 95 (FIGS. 4A, 4B), may be provided on one or more of the extensions or guides 230 or the power supply unit 210 to assist in retention of the cord in a wrapped configuration about the power supply unit 210.

A number of implementations and alternatives have been described. Nevertheless, it will be understood that various modifications may be made without departing from the spirit and scope of the disclosure. For example, although the extension or guides 30 are shown as substantially flat longitudinally extending elements, the extensions or guides 30 may have any suitable shape such as cylinders, oval cross-sectional, rectangular cross-sectional, or other shapes and configurations to optimize contact with the power supply unit 10. Moreover, although the extensions or guides 30 are shown extending from the body of the power supply unit 10, the extensions or guides 30 may be disposed within the body when not in use and moved to a position extending away from the body when in use. For example, the extensions or guides 30 may reside in mating pockets formed in the power supply unit 10 when not in use, and triggered, by the push of a button or manually to extend from the power supply unit 10. Moreover, the extensions or guides 30 may be made from any suitable materials, such as plastic, metals, or applicable material. In addition, although the cord wrap of, for example, FIG. 1 has been shown with notches or grooves 60 formed in each of the guides 30, the cord wrap can be formed with only one guide 30 having a groove 60, or with grooves 60 formed in the ends of two or more of the guides 30.

Accordingly, other implementations are within the scope of the disclosure.

What is claimed is:

1. An apparatus comprising:

a power supply unit comprising a top surface, a bottom surface, a first pair of opposing side surfaces, and a second pair of opposing side surfaces, the first and second pair of opposing side surfaces disposed between the top surface and the bottom surface;

a high voltage power cord releasably coupled to a first side surface of the first pair of opposing side surfaces;

a low voltage power cord coupled to a second side surface of the first pair of opposing side surfaces;

a first pair of substantially planar extensions configured to be coupled to a first side surface of the second pair of opposing side surfaces of the power supply unit such that when coupled to the first side surface of the second pair of opposing side surfaces of the power supply unit, the first pair of extensions extend outwardly from the power supply unit and transverse to the first side surface of the first pair of opposing side surfaces of the power supply unit; and a second pair of substantially planar extensions configured to be coupled to a second side surface of the second pair of opposing side surfaces of the power supply unit such that when coupled to the second side surface of the second pair of opposing side surfaces of the power supply unit, the second pair of extensions extend outwardly from the power supply unit and transverse to the second side surface of the first pair of opposing side surfaces of the power supply unit, the first pair and the second pair of extensions cooperating with the first side surface and the second side surface, respectively, to form open channels between the first and second pair of extensions and the first and second side surfaces, respectively, such that the high voltage power cord and the low voltage power cord can be wrapped around the power supply unit and held in place against the first and second side surfaces and between the first and second pair of extensions within the open channels, wherein one extension of the first pair of extensions and one extension of the second pair of extensions defines a notch in an end of the extension that is configured to receive and retain a part of a flexible portion of one of the high voltage power cord and the low voltage power cord, wherein the first and second pair of extensions have widths that are substantially the same as widths of the second pair of opposing side surfaces of the power supply unit and wherein no portion of the open channels is formed by the second pair of opposing side surfaces of the power supply unit.

2. The apparatus of claim 1, wherein each extension of the first and second pair of extensions defines a notch in an end of the extensions that is configured to receive and retain a part of the flexible portion of one of the high voltage power cord and the low voltage power cord.

3. The apparatus of claim 2, wherein the notch comprises a wedge-shaped notch configured to receive and retain a part of the flexible portion of one of the high voltage power cord and the low voltage power cord.

4. The apparatus of claim 2, wherein the notch comprises a substantially circular notch and wherein one extension of the first pair of extensions and one extension of the second pair of extensions further defines a retention mechanism for retaining the part of the flexible portion of one of the high voltage power cord and the low voltage power cord within the substantially circular notch.

5. The apparatus of claim 1, wherein the notch comprises a wedge-shaped notch configured to receive and retain a part of the flexible portion of one of the high voltage power cord and the low voltage power cord.

6. The apparatus of claim 1, wherein the notch comprises a substantially circular notch and wherein one extension of the first pair of extensions and one extension of the second pair of extensions further defines a retention mechanism for retaining the part of the flexible portion of one of the high voltage power cord and the low voltage power cord within the substantially circular notch.

7. The apparatus of claim 1, wherein the first and second pair of extensions are releasably attachable to the power supply unit.

8. The apparatus of claim 1, wherein the recess is defined within a clip disposed on at least one end of each of the plurality of extensions.

9. The apparatus of claim 1, wherein when not in use the plurality of extensions are disposed within the power supply unit, and when in use extend from the power supply unit.

10. An apparatus comprising:

a first longitudinally extending and substantially planar guide configured to be coupled to a first side surface of a first pair of opposing side surfaces of a power supply unit and a second longitudinally extending and substantially planar guide configured to be coupled to a second side surface of the first pair of opposing side surfaces of the power supply unit, the first and second longitudinally extending guides having widths that are substantially the same as widths of the first pair of opposing side surfaces, the power supply unit further comprising a second pair of opposing side surfaces, a top surface, and a bottom surface, such that, when coupled to the first and second side surfaces of the first pair of opposing side surfaces of the power supply unit, the first and second longitudinally extending guides cooperate with each other and with the second pair of opposing side surfaces of the power supply unit to form open channels between the guides such that an electrical power cord can be wrapped around the power supply unit and held in place against the second pair of opposing side surfaces of the power supply unit and between the guides within the open channels, and wherein at least one end of each of the guides defines a notch that is configured to receive and retain a part of a flexible portion of the electrical power cord and to cooperate with the power supply unit to retain the electrical power cord in a wrapped arrangement around the power supply unit, and wherein no portion of the open channels is formed by the first pair of opposing side surfaces of the power supply unit.

11. The apparatus of claim 10, wherein the longitudinally extending guides comprise a substantially rectangular or oval cross-sectional body.

12. The apparatus of claim 10, wherein the longitudinally extending guides are shaped to match the contours of the first and second side surfaces of the first pair of opposing side surfaces of the power supply unit or the longitudinally extending guides comprise materials that permit the guides to substantially conform to the contours of the first and second side surfaces of the first pair of opposing side surfaces of the power supply unit.

13. The apparatus of claim 10, wherein each end of each of the guides defines a notch configured to receive and retain a part of the flexible portion of the electrical power cord, the notch comprising a wedge-shaped notch.

14. The apparatus of claim 10, wherein each of the guides further comprises an adhesive material disposed along a length of a side of each of the guides, the adhesive material configured to interact with the power supply unit to couple the guides to the power supply unit.

15. The apparatus of claim 14, wherein the adhesive material comprises one of glue, adhesive strips, or a hook and loop fastener material.

16. An apparatus comprising:

a first longitudinally extending and substantially planar guide configured to be attached to a first side surface of a first pair of opposing side surfaces of a power supply unit and a second longitudinally extending and substantially planar guide configured to be attached to a second side surface of the first pair of opposing side surfaces of the power supply unit, the power supply unit further comprising a second pair of opposing side surfaces, a top surface, and a bottom surface, such that, when attached to the first and second side surfaces of the first pair of opposing side surfaces of the power supply unit, the first longitudinally extending guide having a width such that the first longitudinally extending guide covers substantially all of the first side surface of the first pair of opposing side surfaces of the power supply unit and the second longitudinally extending guide having a width such that the second longitudinally extending guide covers substantially all of the second side surface of the first pair of opposing side surfaces of the power supply unit, and the first and second longitudinally extending guides cooperate with each other and with the second pair of opposing side surfaces of the power supply unit to form open channels between the guides and the second pair of opposing side surfaces such that an electrical power cord can be wrapped around the power supply unit and held in place against the second pair of opposing side surfaces of the power supply unit and between the guides within the open channels, and wherein at least one end of each of the guides defines a notch that is configured to receive and retain a part of a flexible portion of the electrical power cord and to cooperate with the power supply unit to retain the electrical power cord in a wrapped arrangement around the power supply unit.

17. The apparatus of claim 16, wherein no portion of the open channels is formed by the first pair of opposing side surfaces of the power supply unit.

18. An apparatus comprising:

a power supply unit comprising a top surface, a bottom surface, a first pair of opposing side surfaces, and a second pair of opposing side surfaces, the first and second pair of opposing side surfaces disposed between the top surface and the bottom surface;

a first pair of substantially planar extensions configured to be coupled to a first side surface of the second pair of opposing side surfaces of the power supply unit such that when coupled to the first side surface of the second pair of opposing side surfaces of the power supply unit, the first pair of extensions extend outwardly from the power supply unit and transverse to a first side surface of the first pair of opposing side surfaces; and a second pair of substantially planar extensions configured to be coupled to a second side surface of the second pair of opposing side surfaces of the power supply unit such that when coupled to the second side surface of the second pair of opposing side surfaces of the power supply unit, the second pair of extensions extend outwardly from the power supply unit and transverse to a second side surface of the first pair of opposing side surfaces, the first pair and the second pair of extensions cooperating with the first side surface and the second side surface, respectively, to form open channels between the first and second pair of extensions and the first and second side surfaces of the first pair of opposing side surfaces, respectively, such that an electrical power cord can be wrapped around the power supply unit and held in place against the first and second side surfaces and between the first and second pair of extensions within the open channels, wherein one extension of the first pair of extensions and one extension of the second pair of extensions defines a notch in an end of the extension that is configured to receive and retain a part of a flexible portion of one of the high voltage power cord and the low voltage power cord, wherein the first and second pair of extensions have widths that are substantially the same as the widths of the second pair of opposing side surfaces of the power supply unit and wherein no portion of the open channels is formed by the second pair of opposing side surfaces of the power supply unit.

* * * * *